United States Patent [19]

Morris et al.

[11] 3,942,201

[45] Mar. 9, 1976

[54] WALL SLEEVE AND PLUMBING INSTALLATION JIG

[75] Inventors: Earl L. Morris; Theodore J. Sally, both of Whittier, Calif.

[73] Assignee: Acorn Engineering Co., City of Industry, Calif.

[22] Filed: Sept. 9, 1974

[21] Appl. No.: 504,423

Related U.S. Application Data

[63] Continuation of Ser. No. 331,016, Feb. 9, 1973, abandoned.

[52] U.S. Cl. ..... 4/252 R

[51] Int. Cl.[2] ..... E03D 11/00

[58] Field of Search ..... 49/55; 4/252 R

[56] References Cited

UNITED STATES PATENTS

| | | | |
|---|---|---|---|
| 1,662,117 | 3/1928 | Kuhl | 49/55 |
| 1,996,693 | 4/1935 | Wallace | 4/252 R |
| 3,129,437 | 4/1964 | McClenahan | 4/252 R |
| 3,701,172 | 10/1972 | McClenahan | 4/252 R |

*Primary Examiner*—Harvey C. Hornsby
*Assistant Examiner*—Donald S. Massenberg
*Attorney, Agent, or Firm*—Ben E. Lofstedt

[57] ABSTRACT

A plumbing installation jig and wall sleeve is provided for the secure and rapid installation of plumbing fixtures through concrete, gunite, masonry walls and the like. The device includes a single rectangular sleeve, with precisely located individual tubes for the anchor bolts which accurately position the fixture, and security bars which are attached to at least two of the parallel walls of the rectangular sleeve.

4 Claims, 4 Drawing Figures

WALL SLEEVE AND PLUMBING INSTALLATION JIG

This is a continuation of application Ser. No. 331,016, filed Feb. 9, 1973 now abandoned.

BACKGROUND OF THE INVENTION

1. Field of the Invention

This invention relates to an installation device for plumbing fixtures and more specifically relates to a device for the installation of vandal-proof, institution type fixtures which can only be adjusted, serviced, or removed from the rear of the wall to which the plumbing fixture is attached.

2. Prior Art

In many institutional facilities, such as penal institutions, mental hospitals and the like, it is desirable to have vandal-proof plumbing fixtures which can be adjusted or repaired without the need for service personnel to enter the cell area. These fixtures are installed in such a manner to prevent inmates from rendering the fixture inoperative or to prevent them from removing portions of the fixture which may be used as man-endangering weapons or escape tools.

To promote the rapid, inexpensive and secure installation of such vandal-proof plumbing fixtures, a device is provided, in accordance with the present invention, for this purpose. In addition, the present invention is particularly useful when a plumbing fixture is installed in a relatively thick wall such as concrete or the like.

Similar devices as found in the prior art include items such as disclosed in U.S. Pat. Nos. 3,129,437 and 3,701,172. These installation jigs are typified by the use of an aperatured plate or plates with multiple sleeves extending from the aperatures in the plate or plates throughout at least the thickness of the wall to be constructed.

Further, the use of such plumbing fixture jigs is limited to poured or gunite concrete walls, and is not readily adaptable for use in masonry or block wall construction.

It should be also noted that such apertured plate and multiple sleeved jigs must be modified to accommodate changes in the location of water pipe and drain outlets in the plumbing fixture when and as these locational changes occur.

In addition, such sleeved assemblies must frequently be removable from the apertured plates both for use in forming the wall and for removal therefrom following the formation of the wall.

Newer combination plumbing fixtures may incorporate as an integral part of the fixture ventilation louvers or small multiple apertures through which the ventilation air may pass from behind the wall, into the fixture and thereafter into the room or cell. When such plate and sleeve jigs are used in the formation of passageways in the wall for plumbing pipes and the like, the total area of the passageways is very small. Limiting the total passageway area in the wall greatly restricts and oftentimes, practically speaking, eliminates the pipe chase as a means for serving as an air ventilation duct.

SUMMARY OF THE INVENTION

In general, the device of the present invention comprises a rectangular sleeve having oppositely-disposed openings thereinto. One opening faces the front of the sleeve; the opposite opening faces the rear of the sleeve. A flange is formed about the rim of the rear opening to the sleeve and is directed outwardly from the geometric center of the body of the sleeve in a substantially radial fashion therefrom. V-shaped notches cut into the flange serve as reference or locating marks in order to precisely locate pipe centers and/or other points on the plumbing fixture located on the other side of the wall to be constructed. Small perforations in the flange serve as receptacles for fasteners by which to anchor the sleeve to a form for forming a concrete wall and/or to help anchor the sleeve to the formed wall.

An appropriate number of metal bars are passed through matching perforations in at least two of the parallel sidewalls of the rectangular sleeve and are welded to the sidewalls. The ends of the metal bars protrude beyond the outside surfaces of the sidewalls so that the bars may be firmly and permanently embedded in the wall to be formed around the sleeve and plumbing fixture jig.

A flanged rim about the rear opening to the sleeve is directed inwardly towards the geometric center of the sleeve and is disposed at an angle of less than ninety degrees with respect to the body of the sleeve. Further, the flanged rim about the rear opening to the sleeve is disposed within the sleeve rather than outside the sleeve as in the case of the flange disposed about the rear opening to the sleeve.

A number of small tubular sleeves are welded to the outside of the sleeve and are typically located near the corners of the sleeve. These tubular sleeves serve as precisely located guides for the plumbing fixtures wall anchoring fasteners.

DESCRIPTION OF THE PREFERRED EMBODIMENT

Figure 1:
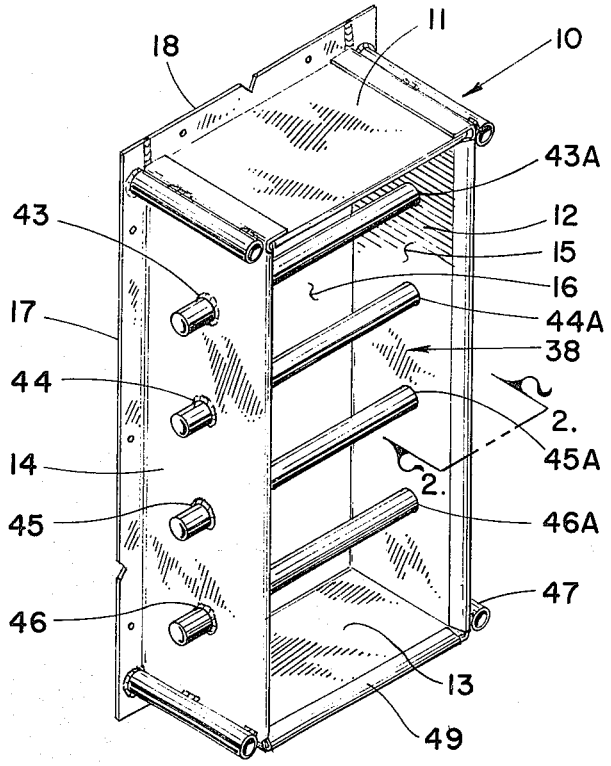
FIG. 1 is a perspective view of a device embodying the invention.
Figure 2:
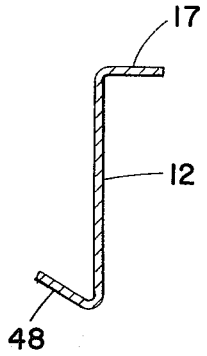
FIG. 2 is a crossection of the wall of the device of the present invention taken along plane 2—2.

With continued reference to the drawings, it is clearly shown that the sleeve and jig of the present invention is generally designated 10, and is generally rectangularly shaped, having four sidewalls, 11,12,13,14 and two open ends an open end 15 facing the front of the sleeve and an open end 16 facing the rear of the sleeve.

A flange 17 rims the periphery of the open end 16 and is directed outwardly in a radial fashion away from the central axis of the sleeve.

The body 18 of the flange 17 is notched with a number of V-notches, 19,20,21,22. The V-notches are utilized as reference planes and locating points, so that the same identical points and planes may be located on the opposite side of the wall after construction or formation of the wall 33. The body 18 of the flange 17 is also perforated to provide a number of holes 23, 24, 25, 26, 27, 28, 29, 30, 31, 32 therein, whereby fasteners may be used to affix the sleeve to a form into which concrete is poured or sprayed to form a wall.

At least four tubular sleeves 34,35,36,37 are disposed about the outer portion of the body, generally indicated at 38 of the sleeve and jig 10 and welded, soldered or brazed to the body 38. These tubular sleeves are provided as guides and locating members for bolts used in fastening the vandal-proof plumbing fixture 39 to the wall 33. It will be understood, of course, that these specific sleeves are designed for a specific plumbing fixture and that the sleeves would differ in number and size depending upon the particular fixture to be accomodated.

Figure 3:
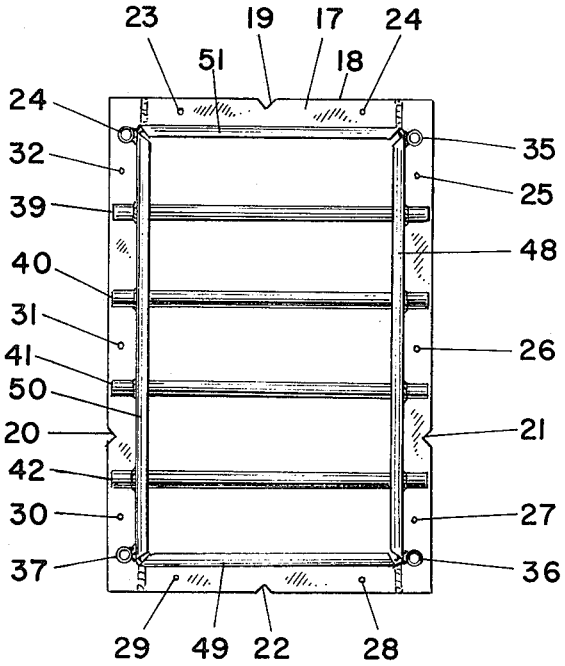
FIG. 3 is a rear elevational view of a device embodying the present invention.
Figure 4:
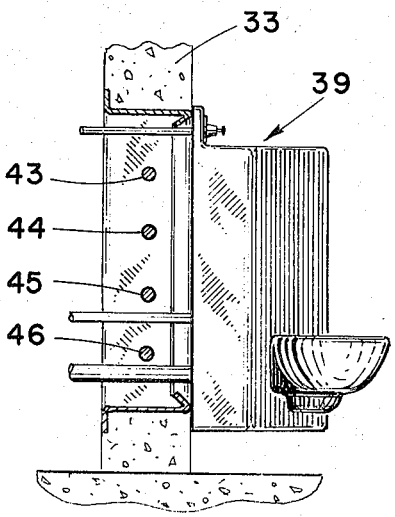
FIG. 4 is a side sectional view showing the manner in which the device of the present invention is employed for poured concrete, gunite, masonry or block walls.

Four metal bars 39,40,41,42 are disposed through matching perforations 43,43A; 44,44A; 45,45A; 46,46A in the sidewalls 12,14 and permanently attached thereto by any desired means such as welding, brazing or soldering. The ends of these bars protrude an appropriate distance beyond the sidewalls 12,14 and are either cast or grouted into the wall 33 as the wall is constructed. The purpose of these bars is to prevent an inmate from leaving the cell and entering the pipe chase located on the other side of the cell wall 33 in the event that the vandal-proof plumbing fixture is not installed or is otherwise removed from its position on the wall 33. In addition to providing added security for institutional use, it should be noted that such bars do not measurably block the flow of ventilation air from the pipe chase through the wall to the vandal-proof plumbing fixture with louvers or perforations therein, thereby insuring an adequate supply of air to the cell area. It should be readily noted, however, that depending on the size of the plumbing fixture and the number of plumbing connections thereto as well as the physical size of the institutional inmates, the number of bars hereinbefore described, may be more or less than the four shown and illustrated in FIGS. 1,3,4. In addition, the reinforcing bars, when welded in place to the sleeve wall, provide the desired reinforcement of the entire sleeve. When concrete is poured into a form, the sleeve 38 may be located some 7–10 feet below the point where the concrete is poured and/or the wall is topped off. The concrete is then agitated with a snake-like vibrator to promote settling of the concrete within the form and around the sleeve and jig 10. Such vibration coupled with the weight of either or both the effects of the weight of the concrete as it is being poured onto the sleeve and jig 10 and/or as it is settling in the form and topped off, places considerable force on the exterior of the sleeve and jig 10. Such stress can cause deformation of the sleeve 38 producing not only distortion of the sleeve and the cross-sectional area thereof, but also would reduce the cross-sectional area of the passageway to be formed by the sleeve in the concrete or masonry wall. Such a reduction of the crossectional area could very readily interfere with connecting pipe to the plumbing fixture 39 and/or dislocate the tubular sleeves 34,35,36,37 which must be maintained in precise locations in order to be properly aligned with the receptacles in the plumbing fixture for receiving the anchoring fasteners thereto.

To provide dimensional integrity, stiffness and strength to the rim 47 of the open end 15 of the sleeve body 38, the edges 48,49,50,51 are turned inwardly so that each lies at an angle of less than 90° with respect to the body 38 of the sleeve and jig 10. In so doing, the desired stiffness and strength needed by the rim is obtained without the need to create a flanged rim like that flange 17 of the open end 16. Such a rim would be undesirable around open end 15 because it would not permit the sleeve and jig 10 to be removed following the construction of the wall 33. As heretofore mentioned, removal of the sleeve and jig 10 is sometimes desirable depending upon wall construction details. Of course, should it be desirable or necessary to insure that the sleeve and jig be removable, the ends of the bars 39,40,41,42 would have to be cut so that the ends of these bars were flush with the sidewalls 12,14 of the sleeve body 38.

Additionally, if the rim 47 were flanged similar to flange 17 when the sleeve and jig 10 is used in a masonry wall, the blocks would have to fit between the two flanges. Blocks are not made to such a close tolerance and the fit between the flanges and the blocks would be frequently loose. This would result in a poor and unacceptable installation. With the edges 48,49,50,51 formed at an angle of less than 90° with respect to the body 38, the grout is merely smoothed off with the grout between the blocks and forming a good solid base for the sleeve and jig 10.

It should also be noted that in many cases vandal-proof plumbing fixtures are anchored to the wall via bolts which are threadably mated to threaded receptacles in the flanged rim located at the rear of the plumbing fixture. Such peripheral anchoring of the plumbing fixture does not economically permit close tolerance installations. Should a radial, outwardly-directed flange be disposed about rim 47 in lieu of edges 48,49,50,51, such a flange would frequently project beyond the rim of the rear of the plumbing fixture and would be objectionable.

One reason that such would be objectionable is that the plumbing fixture has a finished surface and is constructed of an expensive material which is capable of withstanding much abuse. The sleeve and jig 10 is not so constructed simply because there are no requirements to do so and it would be economically unfeasible from a commercial standpoint.

Further, such a flange would require perforations to allow the anchoring fasteners to be passed through the tubular members 34, 35, 36, 37 so that such fasteners could be attached to the plumbing fixture.

The invention in its broader aspects is not, however, limited to the specific details shown and described but departures may be made from such details without departing from the principles of the invention and without sacrificing its chief advantages.

What we claim is:

1. A combination sleeve and jig for the rapid and accurate installation of plumbing fixtures in an opening in a concrete or masonry wall, comprising in combination:

a. a sleeve defined by a wall thereabout, said wall of said sleeve bridging the distance betweeen the pair of oppositely-disposed faces of said wall and defining a single, rectangularly-shaped passageway therethrough, said sleeve having front and rear portions and a plurality of paired, oppositely-disposed apertures in the longitudinal, oppositely-disposed portions of said wall of said sleeve and further having a first flange disposed about the rim of said front portion of said sleeve and wherein said first flange is turned inwardly towards the geometric center of said sleeve and forms an angle with said wall of said sleeve from which said first flange is generated which is less than ninety degrees;

b. a plurality of rods each of which is transversely disposed across said sleeve passageway and within said pair of oppositely-disposed apertures in said sleeve wall and projecting therebeyond and further being fixedly secured to said sleeve wall disposed about said apertures;

c. a second flange, said second flange rimming said rear portion and extending outwardly in a substantially radial fashion therefrom and having at least four openings therethrough, said openings being adjacently disposed to the corners of said rectangularly-shaped sleeve passageway; and d. at least four tubular members, one open end of each of said members being fixedly secured about one of said openings in said second flange of said sleeve, each of said members being also fixedly secured to said sleeve and disposed in parallel relationship to the longitudinal axis of each of said four corners of said rectangularly-shaped passageway of said sleeve.

2. The combination sleeve and jig of claim 1 wherein said first flange forms an angle of 45° with respect to said sleeve wall from which it is generated.

3. The combination sleeve and jig of claim 1, wherein said second flanged rim has a plurality of perforations therethrough.

4. The combination sleeve and jig of claim 3, further comprising at least two pairs of V-shaped notches, each pair of notches being oppositely-disposed on said second flange so that the bottom of the V is in alignment with the bottom of the other V of the other notch of the pair.

* * * * *